United States Patent [19]

Watson et al.

[11] Patent Number: 4,973,193

[45] Date of Patent: Nov. 27, 1990

[54] KWIK-SET MAT SYSTEM

[75] Inventors: Orville W. Watson; Charles D. Domingûe, both of Lafayette, La.

[73] Assignee: Central Industries, Inc., Lafayette, La.

[21] Appl. No.: 401,652

[22] Filed: Aug. 31, 1989

[51] Int. Cl.[5] ..... E01C 5/14; E01C 9/08

[52] U.S. Cl. ..... 404/35; 404/41; 404/46

[58] Field of Search ..... 404/34, 35, 36, 41, 404/46; 52/578, 588

[56] References Cited

U.S. PATENT DOCUMENTS

| | | | |
|---|---|---|---|
| 619,934 | 2/1899 | Buchtel | 404/41 |
| 2,652,753 | 9/1953 | Smith | 404/41 |
| 2,819,026 | 1/1958 | Leyendecker | 404/41 X |
| 2,912,909 | 11/1959 | Hart | 404/36 |
| 3,964,221 | 6/1976 | Berquist | 404/41 X |
| 4,289,420 | 9/1981 | Davis et al. | 404/35 |
| 4,462,712 | 7/1984 | Penland, Sr. | 404/36 |
| 4,600,336 | 7/1986 | Waller, Jr. | 404/35 |
| 4,875,800 | 10/1989 | Hicks | 404/35 |
| 4,889,444 | 12/1989 | Pouyer | 404/34 |

OTHER PUBLICATIONS

Uni-Mat Advertisement, Uni-Mat International Inc., Houston, Tex. 1 page, date unknown.

*Primary Examiner*—Stephen J. Novosad

*Attorney, Agent, or Firm*—Joseph L. Lemoine, Jr.

[57] ABSTRACT

An apparatus and method for constructing a reusable wooden matting system for use as a temporary surface at construction sites. The matting system includes interlocking mats of four differing configurations. Each mat configuration consists of wooden boards fastened together to create from one to three layers of boards at various areas of the individual mats. When interlockingly installed a desired area is uniformly covered with three layers of boards. The upper, working layer of boards, bears the vehicular traffic or equipment placement. The middle, intermediate layer of boards, consists of interlock boards which fittingly interlock with corresponding spaces of adjacent mats, and, interspace boards to reinforce the weight bearing characteristics of the mats. The lower, contact layer of boards, rest upon the terrain. Within a layer the boards are parallel to one another, whereas the boards of each layer are perpendicular to the boards of any adjacent layer. When installed each mat interlockingly overlaps or underlaps approximately one-third of the width and one-half of the length of laterally adjacent mats. Both lateral and longitudinal relative movement of any installed mat is substantially precluded by a portion of each mat unit being in frictional engagement with the terrain, by a portion of each mat unit overlapping interlocking with adjacent mats and all three layers of each mat laterally and longitudinally abutting other mats which are also in frictional engagement with the ground.

8 Claims, 3 Drawing Sheets

KWIK-SET MAT SYSTEM

BACKGROUND OF THE INVENTION

1. Field of the Invention:

This invention relates generally to a removable, reusable roadway and equipment placement surface. More particularly, it relates to a wooden mat system comprised of a combination of mat units consisting of a plurality of boarded layers of which said units are easily and quickly interlocked so as to form a roadway and/or equipment surface. The system is typically for use to access petroleum industry drilling locations located on terrain of insufficient conformance to accommodate travel or placement of related equipment.

1. Prior Art:

The use of wooden boards installed in a variety of fashions has long been used for the construction of roadways upon terrain which is not compatible with the desired form of transportation. This is particularly prevalent in accessing oil and gas drilling locations. More recently, a variety of mat systems, both wooden and otherwise, have been developed to accomplish the same objective. Several patents disclose various mat systems as follows:

Robishaw, U.S. Pat. No. 2,639,650, discloses a Prefabricated Runway Construction comprising a corrugated and trussed designed series of metal mats, which provide a corrugated surface in its final position. This patent provides both a discontinuous bearing surface for contact with the terrain and does not provide a substantially smooth working surface. It is apparent from the disclosures that assembly of this mat system requires intricate fitting by side to-side sliding action and fitting of numerous corresponding corrugated shapes. Furthermore, this patent does not provide connecting means for lateral mat placement.

Smith, U.S. Pat. No. 2,652,753, discloses Intermeshing Sectional Matting comprising a series of wooden mats of multiple layers constructed of wooden boards, intermittently-spaced longitudinally to provide an intermeshing end to end connection.

Leyendecker, U.S. Pat. No. 2,819,026, discloses Road Construction comprising a plurality of wooden sections interfitted in a longitudinal manner and retained by lateral strapping means. Assembly of this system requires "weaving" of a strapping means between adjacent connected sections. Further, the disclosures make no provision for lateral section attachment or connection.

Hart, U.S. Pat. No. 2,912,909, discloses Portable Road and Turn-Around comprising a plurality of wooden sections interfitted in longitudinal and lateral manners to create substantially flush upper and lower surfaces. Assembly of this system produces a systematic, non continuous contact with the terrain, producing intermittent contact layer support. Alternatively, to effect a substantially continuous contact layer support, alternating sections must be precisely placed at measured distances from each other to facilitate later placement of the interconnecting system.

Davis, et al, U.S Pat. No. 4,289,420, discloses a Wooden Mat for use as a temporary roadway comprising longitudinally and laterally spaced interdigitated boards. It is apparent that this system requires intricately precise relative placement of each mat section involving substantial installation time. Further, this disclosure makes provision for lateral expansion in only a single lateral direction.

Penland, Sr., U.S. Pat. No. 4,462,712, discloses a Method and Apparatus for a Construction Site Flooring System comprising a plurality of wooden boards with longitudinally locking tabs and slots. This patent makes no disclosure of means to facilitate lateral connection and expansion of said flooring mats.

Waller, Jr., U.S. Pat. No. 4,600,336, discloses an Interlocking Wooden Mat comprising wooden mat system with intermeshing longitudinal and lateral boards retained by tie-in planks nailed to the main mat sections. Disclosures of this patent reveal interconnecting means requiring intricate and complex assembly procedures involving substantial installation time.

Hicks, U.S. Pat. No. 4,875,800 is comprised of identially similar individual mats, each comprised of a layer of parallel boards attached to a half layer of parallel boards disposed perpendicular to the first layer. When two layers of these mats are laid together a 3-layer surface is formed. The top "one and one-half" mat is mechanically interlocked from sliding over the lower mat in one direction, but is free to slide over the lower mat in a direction parallel to the middle layer of interlocking boards (such as is caused by lateral forces occurring when heavy trucks turn on such surface). Such lateral displacement is commonly known as "walking" of the mats.

Pouyer, U.S. Pat. No. 4,889,444 is comprised of identically similar individual mats, each comprised of a layer of parallel boards attached to a half layer of parallel boards disposed perpendicular to the first layer. When two layers of these mats are laid together a traditional 3-layer surface is formed. The top "one and one half" mat is mechanically interlocked from sliding over the lower mat in one direction, but is free to slide over the lower mat in a direction parallel to the middle layer of interlocking boards (such as is caused by lateral forces occurring when heavy trucks turn on such surface). Such lateral displacement is commonly known as "walking" of the mats.

None of the above patents show the invention disclosed herein. Each mat of the Kwik-Set Mat System disclosed herein has both a full, finished three ply portion and a portion which interlockingly overlaps or underlaps with adjacent mats. By this combination each individual mat is restrained from displacement by both its interlock with adjacent mats, and also by frictional and mechanical engagement with the terrain. By interlocking each mat with both adjacent mats and the terrain itself, displacement of the mats in the horizontal plane is avoided, even with heavy vehicular usage, which is a distinct advantage with the system disclosed herein.

SUMMARY OF INVENTION

In the petroleum and construction industries, it often becomes necessary to access geographical locations over terrain of inadequate composition to support heavy equipment. Many times, the primitive terrain is comprised of marsh, unconsolidated sand or inadequately drained soil. In the petroleum industry, it has become common to use boards in constructing a severally-plied system of roadways and equipment areas. Construction of access roadways and surfaces is currently accomplished by methods ranging from board-by board installation and removal to various, reusable mat designs. Excess time consumption and high labor costs are associated with both the board-by board method and most mat designs because of the intricacies of the interconnecting means. Still other mat designs lack the flexibility to accommodate longitudinal and lateral expansion. Further, other mat designs do not provide for increased weight to bearing are efficiency.

Accordingly, it is therefore an object of the invention to provide a wooden mat system for construction of roadways and equipment surfaces.

Another object of the invention is to provide a wooden mat system capable of facilitating physical support and travel of heavy vehicles and equipment upon substandard terrain.

Yet another object of the invention is to provide a matting system wherein each mat is restrained from horizontal movement by both mechanical contact with the terrain and mechanical interlocking with adjacent mats.

A further object of the invention is to provide a wooden mat system with variously designed individual mats which accommodate a broad range of applications by facilitating expansion of the desired matted surface in all lateral and longitudinal directions.

A further object of the invention is to provide a wooden mat system comprising several, variously-plied mats of which each subsequent mat unit may be installed by use of the previously installed mat unit as the working surface for the installation equipment.

A further object of the invention is to provide a wooden mat system comprising several, variously-plied mats, where installation is accomplished without cumbersome or intricate interlocking or intermeshing means.

A further object of the invention is to provide a wooden mat system comprising several, variously-plied mats which may be installed by simple relative placement.

A further object of the invention is to provide a wooden mat system comprising several, variously plied mats, continuously connected and restrained without use of means additional to simple placement of the individual mats.

A further object of the invention is to provide a wooden mat system comprising several, variously-plied mats, interconnected by interlocking means accomplished by relative placement.

A further object of the invention is to provide a wooden mat system of variously-designed individual mats with an interlocking system which provides a substantially smooth working surface despite imprecise relative mat placement.

A further object of the invention is to provide a wooden mat system with variously-plied mats which provide an optimum weight-to-bearing area ratio.

A further object of the invention is to provide a wooden mat system with variously designed individual mats which optimize load weight distribution throughout the contact terrain.

Other and additional objects of the invention are apparent throughout the details of construction and operation as more fully described herein and illustrated in the accompanying drawings.

BRIEF DESCRIPTION OF THE DRAWINGS

FIGS. 1*a*, 1*b*, 1*c*, 1*d* and 13 are isometric views of the four types of mats comprising the Kwik-Set Mat System, illustrating one example of how various types of mats are fitted together, FIG. 1*a* and FIG. 1*b* are kingpin mats, FIG. 1*c* is a main mat, FIG. 1*d* is a one-half main mat and FIG. 1*e* is a side mat.

FIG. 2*a* is a kingpin mat, FIG. 2*b* is a main mat, FIG. 2*c* is a one-half main mat and FIG. 2*d* is a side mat.

DESCRIPTION OF THE PREFERRED EMBODIMENT

Figures 1A, 1B, 1C, 1D, 1E:
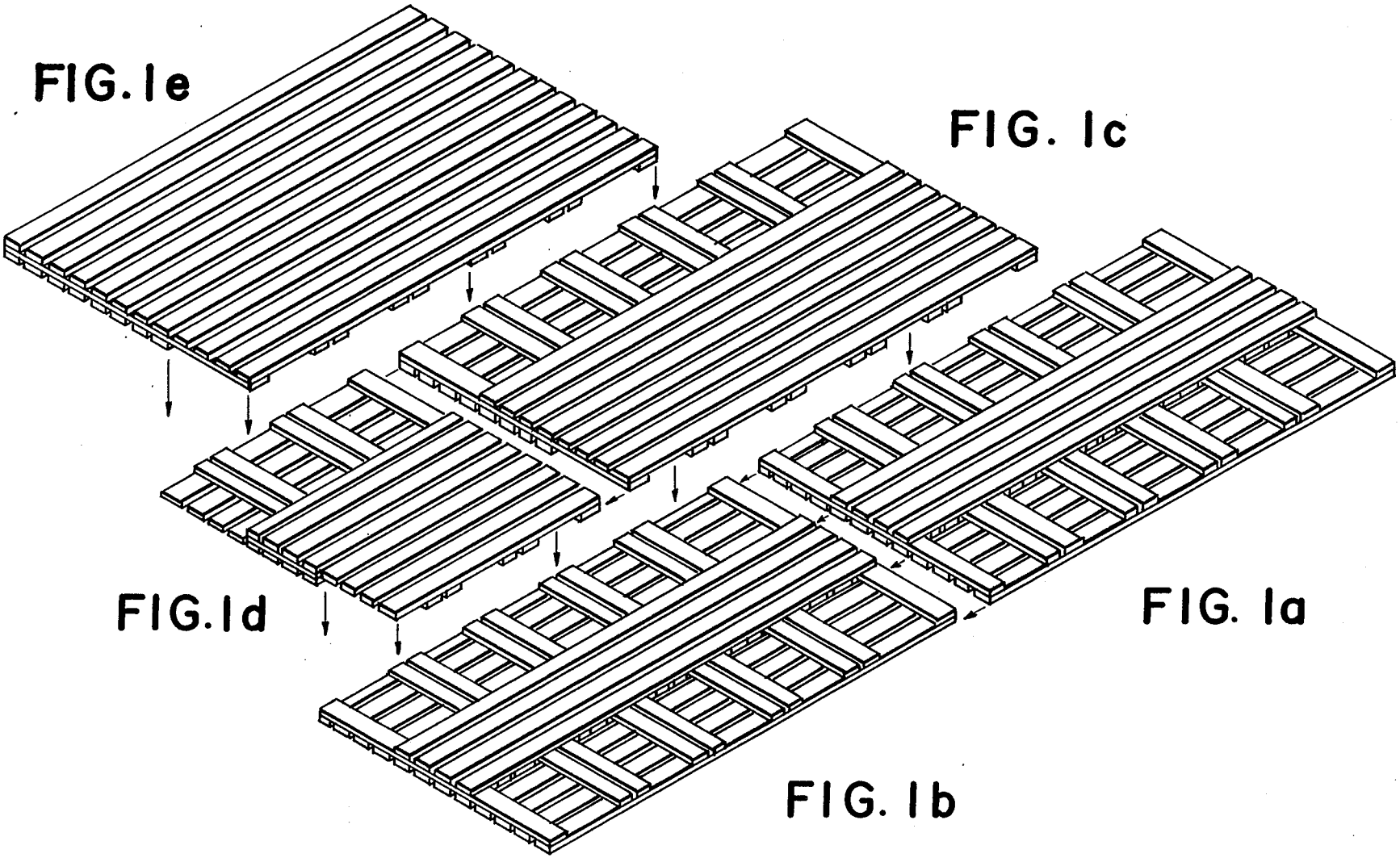
Figure 2E:
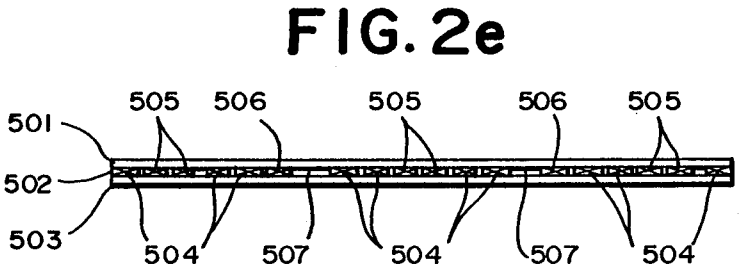
FIG. 2*e* is a sectional view common to FIGS. 2*a*, 2*b* and 2*c*.
Figure 2D:
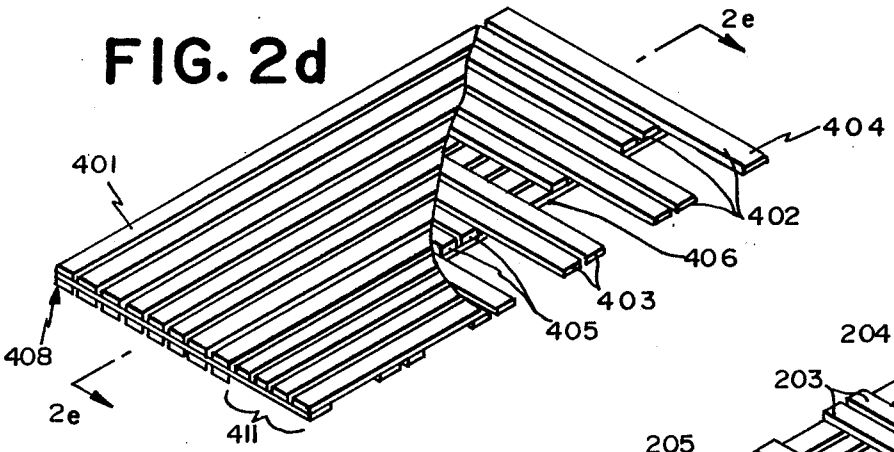
FIGS. 2*a*, 2*b*, 2*c* and 2*d* are cutaway views of the four types of mats comprising the Kwik-Set Mat System.
Figure 2B:
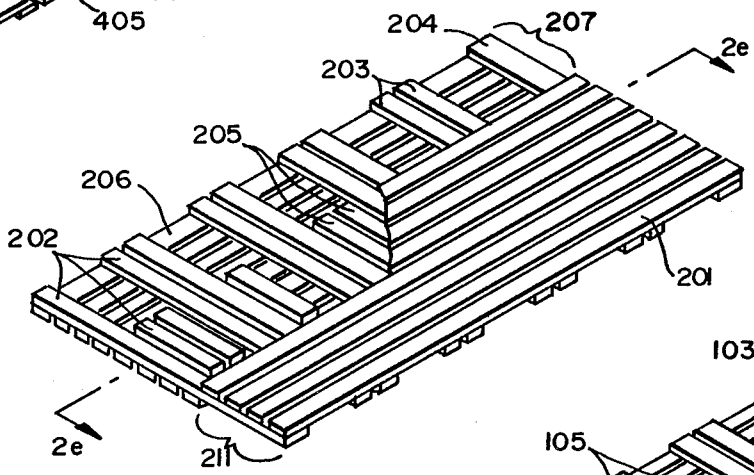
Figure 2A:
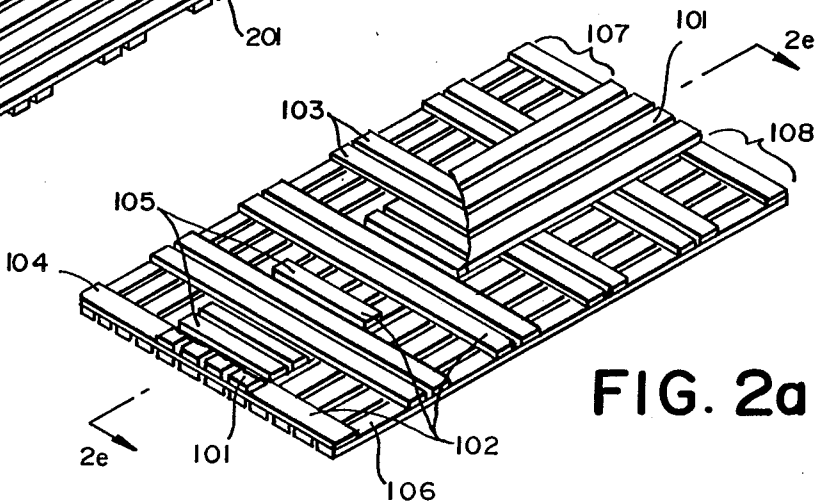
Figure 2C:
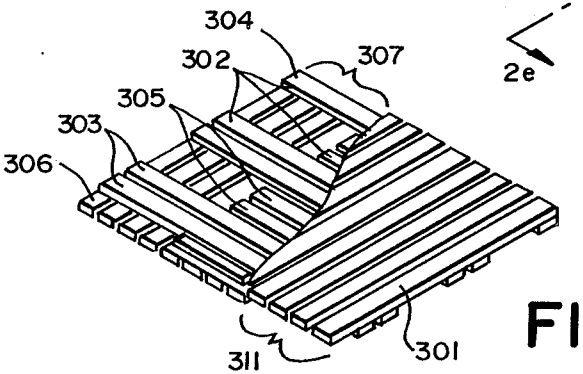

Many petroleum industry exploration and production sites, and other industry construction sites, are located in geographical areas with natural terrain not conducive to and sometimes prohibitive of, heavy equipment travel. Frequently this terrain consists of marshy soil, unconsolidated sand or inadequately drained elastoplastic soil. In order to accomplish work at the particular locale, logistic requirements necessitate temporary enhancement of the terrain integrity. More often than not, industrial profitability requires this be accomplished with optimum economic and time efficiency. The use of a wooden board system has become the widely accepted standard in the petroleum industry. Specifically, access to onshore oil and gas drilling sites is facilitated by placement of a boarded-road system, currently accomplished by a variety of means. Accordingly, the present invention provides a means to construct a temporary, multi plied, boarded roadway or other surface support area by use of various, reusable mats which can be easily and economically installed and removed and which provides an optimally efficient weight-to-bearing area ratio.

The Kwik Set Mat System disclosed herein is comprised for four types of mats, each of a different configuration. These four types of mats are referred to herein as the kingpin mat, the main mat, the one-half main mat, and the side mat. Each type of mat is comprised of three layers of boards, those being: a top, working layer upon which vehicular traffic rides; a bottom, contact layer which rests upon the terrain; and, an intermediate layer, disposed between the working layer and the contact layer, which interlocks with adjacent mats. Within each individual mat, each layer of boards is disposed generally perpendicular to any vertically adjacent layer, and is fastened thereto by nails or other fastening means The first type of mat disclosed herein, the kingpin mat, is shown in detail in FIG. 1(*a*), FIG. 1(*b*) and FIG. 2(*a*). The top, working layer, 101, is comprised of a layer of longitudinally parallel boards which substantially covers the central one third of the mat's width.

The intermediate layer, 102, of the kingpin mat, is comprised of interlock boards, 103 and 104, and interspace boards, 105, which are disposed substantially perpendicular to the working layer, 101, of the mat The interlock boards, 103 and 104, extend laterally to the mat's full width. The interlock board, 104, at each longitudinal end is comprised of a singular board; whereas the interlock boards, 103, between each longitudinal end are comprised of a plurality of pairs of boards, with a gap of substantially two board widths between each pair. Beneath the working layer, only, interspace boards, 105, fill the gaps between the interlock boards, 103 and 104, to enhance the weight bearing characteristics of the working layer, 101. A plurality (usually two) of interspace boards, 105, may be left out to facilitate handling of the kingpin mat, with tined lifting devices, such as forklifts.

The lower, or contact layer, 106, of the kingpin mat, is comprised of a layer of longitudinally parallel boards substantially covering the mat's entire width. The boards of the contact layer, 106, are disposed substantially perpendicular to the boards of the intermediate layer, 103, 104, and 105.

The kingpin mats are those typically used as primary mats, and are generally placed longitudinally parallel to the main direction of vehicular traffic. The underlap flanks, 107 and 108, of the kingpin mat, will interlockingly mate with the overlap flanks of the main mat, one-half main mat or side mats (also disclosed herein) to allow building of a finished three ply matting system of virtually any configuration.

The second type of mat disclosed herein, the main mat, is shown in detail in FIG. 1(*c*) and FIG. 2(*b*). The top, working layer, 201, is comprised of longitudinally parallel boards substantially covering a lateral two-thirds of the mat's width.

The intermediate layer, 202, of the main mat, is comprised of interlock boards, 203 and 204, and interspace boards, 205, which are disposed substantially perpendicular to the top layer, 201. The interlock boards, 203 and 204, extend laterally to the mat's full width. The interlock board, 204, at each longitudinal end of the mat is comprised of a singular board, whereas the interlock boards, 203, between each longitudinal end are comprised of a plurality of pairs of boards, with a gap of two board widths between each pair. Interspace boards, 205, fill the gaps between the interlock boards, 203 and 204, throughout the central one-third of the mat's width, in order to enhance the weight bearing characteristics of the working layer, 201, where said working layer will not be supported by interlock boards of an adjacent mat. A plurality of the interspace boards, 205, may be left out, to facilitate handling of the main mat, 200, with tined lifting devices, such as forklifts.

The bottom, or contact layer, 206, of the main mat, is comprised of a layer of substantially longitudinally parallel boards substantially covering the lower two thirds of the mat which is laterally opposite the two thirds covered by the working layer, 201 The boards of the contact layer, 206, are disposed substantially perpendicular to the boards of the intermediate layer, 203, 204, and 205.

Configured as aforesaid, the main mat has both an overlap flank, 211, and an underlap flank, 207. The overlap flank, 211, will interlockingly mate with any other mat having an underlap flank, including another main mat. The main mat's underlap flank, 208, will interlockingly mate with any other mat having an overlap flank, including another main mat. The main mat is generally used to laterally extend or widen (to any desired degree) the roadway surface usually started with kingpin mats laid end to end longitudinally. In order to achieve maximum longitudinally interlocking effect, approximately one-half of the longitudinal length of the overlap flank of each main mat should be laid over one half of the longitudinal lengths of the underlap flanks of adjacent mats.

The third mat used in the system herein disclosed is the one-half main mat, shown in detail by FIG. 1(*d*) and FIG. 2(*c*) The one-half main mat is substantially similar to the main mat, except that it is only one-half the longitudinal length of a main mat. Since typical installation of main mats is such that each main mat, longitudinally overlaps one-half of the underlap flanks, 107 and 108, of two adjacent kingpin mats, the one-half main mat, is used primarily to start and finish a run of main mats.

Figure 3:
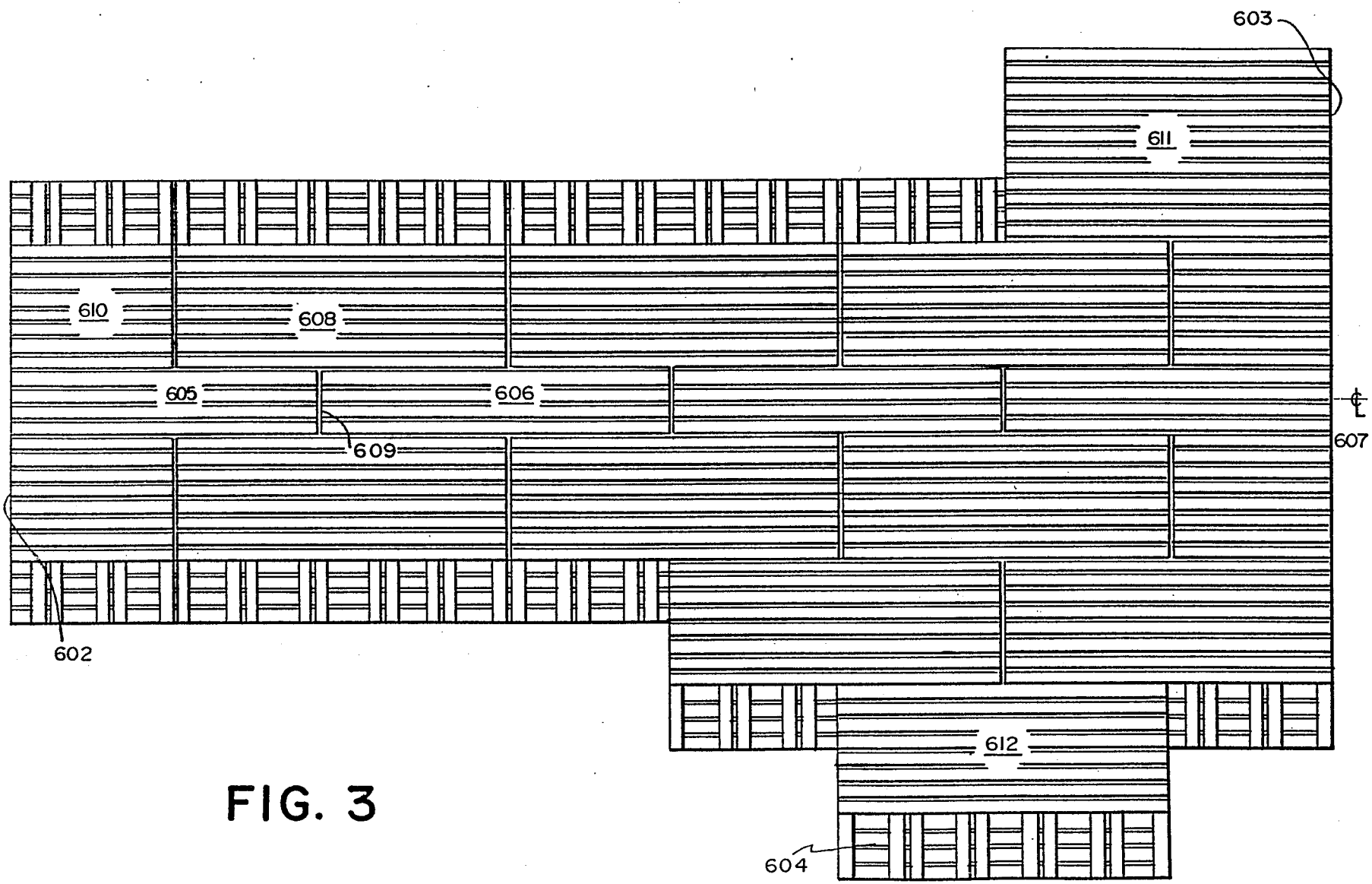
FIG. 3 is a top plan view of an exemplary installation of a temporary construction surface with entrance roadway, turnaround and 90° turn.

The fourth, and last, mat comprising the matting system herein disclosed is the side mat, shown in detail by FIG. 1(*e*) and FIG. 2(*d*). The side mat, is substantially similar to the main mat, 200, except the top layer, 401, of a side mat, covers its entire width, and the side mats interspace boards, 405, are approximately two-thirds of the mat's width and fill the gaps between the interlocking boards, 403 and 404, laterally opposite the side mats overlap flank, 411. The side mat, 400, has no underlap flank, and is used primarily to complete a lateral extension of a matted surface to full three ply thickness, when that is desired. FIG. 2(*e*) illustrates cross-section which is common to kingpin mat, main mat, and side mat, and partially common to one half main mat. Uppermost layer, 501, intermediate layer, 502, and lowermost layer, 503, comprise a multi-plied mat unit. Interspace boards, 505, are situated in pairs between and parallel to interlock boards, 504. Interspace boards, 506, are situated singularly between interlock boards, 504, so as to create slots, 507, to facilitate handling of the mat units with forklift tong-type equipment. FIG. 3 is a plan view of a preferred embodiment illustrating typical use of the four (4) mat designs constructed to form roadway with entrance, 602, turnaround, 603, and 90° turn, 604. Construction of this system is typically initiated by placing kingpin mat, 605, at the desired worksite entrance, using said mat as a vehicular surface for placement of subsequent mats. A successive kingpin mat, 606, is placed adjoining and abutting kingpin mat, 605, on centerline, 607. Main mat, 608, is then placed so as to overlap joint, 609, of kingpin mats, 605, and 606, thereby engaging the interlock system to substantially prevent relative longitudinal movement of kingpin mats, 605, and 606, and main mat, 608. Lateral restraint is effected by frictional shear forces between the contact surface of the mat units and the terrain. One half main mat, 610, may be installed so as to create a squared off entrance, 602, and may be used throughout the system to more fully create a working surface of the desired number of wooden plys. Side mat, 611, is placed at a location of the matted terrain where it is desirable to have a full three ply system to the full extent of the perimeter of the matted construction. Main mat, 612, illustrates a manner of effecting roadway directional change and may be continued to the desired distance by interlock fitting of each successive main mat. Removal is accomplished by reversal of the aforedescribed procedure.

FIG. 3 and the foregoing description represents only one (1) of an unlimited number of combinations in which the Kwik-Set Mat System may be utilized.

Additional and alternative embodiments of this invention may be accomplished by those skilled in the art. For instance, singular boards, or plywood, of double width may be used wherever two parallel boards of singular width are shown in the preferred embodiment.

What is claimed is:

1. A matting system, for constructing a three layer board surface of partially overlappingly interconnected individual mats over a desired area of unimproved terrain, comprising:

(a) a plurality of kingpin mats which are comprised of an upper, working layer of longitudinally parallel boards covering substantially the central one-third of the width of the mat; a lowermost, contact layer of longitudinally parallel boards, which substantially extend the mat's entire width and are substantially parallel to the boards of said working layer; and, an intermediate layer of longitudinally parallel boards disposed between and perpendicular to said working layer and said contact layer, which said intermediate layer is comprised of a singular board at each longitudinal end of the mat, and pairs of boards spaced two board widths apart therebetween, and, (b) a plurality of main mats which are comprised of an upper, working layer of longitudinally parallel boards covering substantially a lateral two-thirds of the width of the mat; a lowermost, contact layer of longitudinally parallel boards oriented substantially parallel to the boards of the working layer, which substantially extend the lateral two-thirds of the mat's width which is horizontally opposite the working layer; and, an intermediate layer of longitudinally parallel boards disposed between and perpendicular to said working layer and said contact layer, which said intermediate layer is comprised of a singular board at each longitudinal end of the mat, and pairs of boards spaced two board widths apart therebetween.

2. A matting system, according to claim 1, further comprising:

(c) a plurality of one-half main mats, which are substantially similar to the above described main mats, except said one-half main mats are one-half the length of the said main mats

3. A matting system, according to claim 1, further comprising:

(c) a plurality of side mats, which are substantially similar to the above described main mats, except their upper working layer covers the entire width of the mat.

4. A matting system, according to claim 2, further comprising:

(d) a plurality of side mats, which are substantially similar to the above described main mats, except their upper working layer covers the entire width of the mat.

5. A matting system, according to claim 1, wherein the intermediate layer of the kingpin mat and intermediate layer of the main mat is further comprised of pairs of boards of a length substantially one third of the width of said mats, which said pairs of boards are centrally disposed between the lateral edges of the mat, between the working layer and contact layer in the two-board width spaces described.

6. A matting system, according to claim 2, wherein said intermediate layer of each mat is further comprised of pairs of spacer boards disposed between the working layer and contact layer, in the two-board width spaces described wherever said working layer and said contact layer vertically overlap.

7. A matting system, according to claim 3, wherein said intermediate layer of each mat is further comprised of pairs of spacer boards disposed between the working layer and contact layer, in the two board width spaces described, wherever said working layer and said contact layer vertically overlap.

8. A matting system, according to claim 4, wherein said intermediate layer of each mat is further comprised of pairs of spacer boards disposed between the working layer and contact layer, in the two board width spaces described, wherever said working layer and said contact layer vertically overlap.

* * * * *